US005438809A

United States Patent [19]

Ehrlich

[11] Patent Number: 5,438,809

[45] Date of Patent: Aug. 8, 1995

[54] MODULAR TILE FLOORING SYSTEM

[75] Inventor: Gernot Ehrlich, Wilmington, N.C.

[73] Assignee: Stone Art, Inc., Wilmington, S.C.

[21] Appl. No.: 144,235

[22] Filed: Oct. 27, 1993

[51] Int. Cl.[6] ..... E04F 15/022

[52] U.S. Cl. ..... 52/390; 52/392; 52/384; 52/311.2; 52/586.1; 52/716.1

[58] Field of Search ..... 52/390, 586.1, 390, 52/392, 384, 716.1, 312, 313, 314, 315, 311.2

[56] References Cited

U.S. PATENT DOCUMENTS

| | | | |
|---|---|---|---|
| 2,030,556 | 2/1936 | Veltung . | |
| 2,269,927 | 1/1942 | Crooks | 52/390 |
| 2,852,932 | 9/1958 | Cable . | |
| 3,209,500 | 10/1965 | Bernett | 52/390 |
| 3,344,011 | 9/1967 | Goozuer | 52/315 |
| 3,512,324 | 5/1970 | Reed | 52/586.1 |
| 3,521,418 | 7/1970 | Bartoloni . | |
| 3,817,021 | 6/1974 | Wack et al. . | |
| 3,950,581 | 4/1976 | Maurin . | |
| 4,169,688 | 10/1979 | Toshio | 52/586.1 |
| 4,409,269 | 10/1983 | Gardner . | |
| 4,415,616 | 11/1983 | Angioletti . | |
| 4,432,177 | 2/1984 | Amesso et al. . | |
| 4,724,638 | 2/1988 | Bezborodko | 52/509 |
| 4,744,194 | 5/1988 | Yasuyoshi . | |
| 4,947,602 | 8/1990 | Pollosky . | |
| 4,947,602 | 8/1990 | Pollasky . | |
| 5,182,891 | 2/1993 | Slocum | 52/392 |

FOREIGN PATENT DOCUMENTS

| | | | |
|---|---|---|---|
| 201759 | 2/1966 | Sweden . | |
| 2193238 | 2/1988 | United Kingdom | 52/390 |

*Primary Examiner*—Carl D. Friedman
*Assistant Examiner*—Christopher Todd Kent
*Attorney, Agent, or Firm*—Bell, Seltzer, Park & Gibson

[57] ABSTRACT

A modular flooring system having multiple modular flooring units and elongate spacer strips. The flooring units include a rigid base, tiles adhesively bonded to the base, and a frame affixed to the base and extending around the tiles to surround the tiles. The base of the flooring unit is substantially impermeable to moisture, and the frame may be made of a laterally compressible material such as wood for absorbing stresses. The tiles may be slate, granite, marble, ceramic or the like. Slots may be formed in the edges of the flooring units and the elongate spacer strips for receiving elongate splines to join the units and strips. The elongate strips may have a thickness substantially identical to the overall thickness of the flooring units, so that a plurality of elongate strips and flooring units may be joined to define a substantially co-planar floor surface. The strips and units may be provided in different sizes so that the dimensions of the flooring system may be varied.

18 Claims, 3 Drawing Sheets

MODULAR TILE FLOORING SYSTEM

FIELD OF THE INVENTION

The present invention relates to a modular tile flooring system. More specifically, the invention relates to a modular tile flooring system having flooring units that may be installed on an existing surface without requiring preparation of a cementitious foundation.

BACKGROUND OF THE INVENTION

Tile prepared from materials such as slate, marble, granite, other types of stone, or various ceramic materials are commonly used as flooring materials due to their decorative appearance and long wear characteristics. Despite these advantages, commonly used tile materials such as stone or ceramic are generally relatively brittle and may not be capable of withstanding substantial bending or tensile loads.

As a result of the foregoing characteristics, the use of tile has historically necessitated somewhat elaborate and extensive installation techniques. For example, tile generally cannot be installed directly over a common wood structure or subfloor, since the support provided by the wooden structure is insufficiently rigid and/or stable. This is due to the tendency of wooden structures to settle over time, to expand, contract or warp due to variations in temperature or moisture, and to flex when subjected to localized loading of the type caused by a person walking on the floor. Such dimensional variations can lead to cracking of many tile materials over a period of time.

To solve the foregoing problems, conventional installation of tile has traditionally involved preparation of a rigid, dimensionally stable base layer which is generally formed by applying a cementitious foundation over a subfloor, which may be wood, brick or one of many other common building materials. The cementitious material is typically applied over wire or a metal grid for additional rigidity. More than one layer of the cementitious material may be necessary to achieve the necessary rigidity. A skim coat of the cement may also be necessary to provide a surface having a sufficiently flat surface for application of the tiles.

Preparation of the cementitious layer is laborious and time consuming. Moreover, since special skills and/or added cost are normally necessary to prepare the cement, and sometimes to add structural reinforcement to a typical wooden floor because of the weight of the cement, traditional tile installation methods are beyond the grasp of ordinary persons working on home improvement projects. Thus, the services of skilled artisans are usually required. Also, after the cementitious base has been prepared, the tiles must be laid, usually by application of mortar, and grout must be applied or worked between the tiles. These steps also require employment of skilled craftsmen.

The foregoing activities can require several days to complete, which, due to the labor involved and delay, makes tile installation quite expensive. In particular, the expense involved in conventional tile installation may be out of the question for many individuals desirous of home improvement projects.

In recognition of the foregoing problems, one attempt to facilitate easy and quick installation of tiles is seen in U.S. Pat. No. 3,521,418 to Bartoloni. The Bartoloni '418 patent shows a pre-finished decorative rigid panel in which tiles are set on a fibrous backing that is impregnated by a plastic resin to bond the tiles to the backing support. However, while the Bartoloni '418 patented panel shows fixing of the tiles in a desired pattern, it may not adequately eliminate the need for preparation of an underlying rigid support, especially if the panel is to be installed above a relatively flexible wooden floor and thereafter subjected to localized loading stresses. Also, the Bartoloni '418 patented tile panels do not include means for interlinking adjacent panels or absorbing stresses between adjacent panels.

Another approach to the foregoing problems is seen in U.S. Pat. No. 2,852,932 to S. J. Cable. The Cable '932 patent shows a tile and grouting assembly in which a frame or lattice is provided for retaining ceramic tiles in place. However, the Cable '932 assembly does not eliminate the need for an underlying cementitious backing but merely eliminates the requirement for grouting between the tiles.

SUMMARY OF THE INVENTION

The present invention provides a tile flooring system which can readily be installed by unskilled individuals including consumers. The subflooring beneath the tile flooring does not require extensive preparation or the application of a cementitious base. In preferred embodiments, the flooring system of the invention can readily be adjusted to cover a room of virtually any size and can include various natural and synthetic tile materials such as ceramic and slate.

The tile flooring of the present invention is provided by a modular flooring system having flooring elements such as a plurality of modular flooring units. The flooring units include a rigid base having upper and lower faces and a plurality of tiles adhesively bonded to the upper face of the base. A compressible frame affixed to the base extends around the tiles to surround the lateral edges of the tiles and to define peripheral edges of the flooring unit. Preferably, each unit includes a plurality of tiles affixed to the base and within the frame. Each flooring unit preferably has a size of less than about one square meter. Because the tile, or tiles, within each modular unit are surrounded by a compressible frame, expansion and contraction of the subflooring and other building parts can be absorbed within the modular unit without substantive harm to the tiles. Because each unit is of limited size and includes a generally rigid base, individual tiles are substantially protected from bending and like tensile forces.

In preferred embodiments of the invention, joining means are associated with at least one of the peripheral edges of each flooring unit for joining the flooring unit to another portion of the modular floor. Advantageously, the tile floor system also includes at least one other modular flooring element of pre-determined size and shape having joining means for being joined to the modular flooring unit of the invention. In the preferred embodiment, the additional flooring element is an elongate spacer strip having a thickness substantially identical to the overall thickness of the flooring units, so that the elongate spacer strips and flooring units may be installed side by side to define a substantially co-planar floor surface. The elongate spacer strips advantageously include an underlying base strip, preferably made of moisture impermeable particle board, and an overlying facing material, preferably of hardwood. Preferably the spacer strips are provided in a plurality of widths so that the spacing between groups of aligned modular flooring units can be adjusted in a variety of different amounts to thereby adjust the dimensions of the assembled floor to fit virtually any room.

It is also preferred that the rigid base of the flooring units be substantially impermeable to moisture and made of particle board, chip board or a similar rigid, moisture impervious material. Also in the preferred embodiment, the compressible frame surrounding the tiles is made of wood or a wood based material, preferably a hardwood such as oak. The frame can have a thickness about the same or not substantially different than that of the tiles. In such cases, the frame is attached to upper face of the base member adjacent its peripheral edges. Alternatively, the frame can have a thickness determined by the sum of the tile and rigid base thicknesses. In this case the frame surrounds both the tiles and the rigid base.

In one advantageous embodiment, the tiles are slate, although other types of stone such as granite or marble may be used, as well as ceramic materials. The modular flooring units may be coated with a protective sealant such as polyurethane. The flooring units may come in varying shapes and sizes; however, it is preferable that the peripheral edges of the flooring units have a length of less than about one meter, and advantageously have a length between about 30 and about 90 cm.

The joining means for the flooring units advantageously include a slot extending along at least one peripheral edge of the flooring unit. The slot is adapted and sized to receive a portion of an elongate spline, so that slots on adjacent flooring portions may each receive one portion of the spline so as to interconnect the adjacent flooring portions. Such joining means are also preferably provided on the elongate spacer strips. The joining means may be used to link adjacent flooring units, adjacent elongate spacer strips, or to join an elongate spacer strip to a flooring unit, in combinations as desired to permit the flooring system to cover a desired surface area.

Because the modular flooring units of the invention do not require a cementitious support and can be assembled by unskilled consumers, the invention substantially increases the practical availability of tile flooring. The system of the invention is desirable even to consumers who do not own a home because the flooring can later be disassembled and moved with the consumer.

BRIEF DESCRIPTION OF THE DRAWINGS

In the drawings which form a portion of the original disclosure of the invention.

DETAILED DESCRIPTION OF THE PREFERRED EMBODIMENT OF THE INVENTION

In the following detailed description of the invention, various preferred embodiments are described in order to provide a full and complete understanding of the invention and its preferred embodiments. It will be recognized that although specific terms are employed, these are employed in the descriptive sense, and it will be understood that the invention is susceptible to numerous and various alternatives, modifications and equivalents as will be apparent to the skilled artisan.

Figure 1:
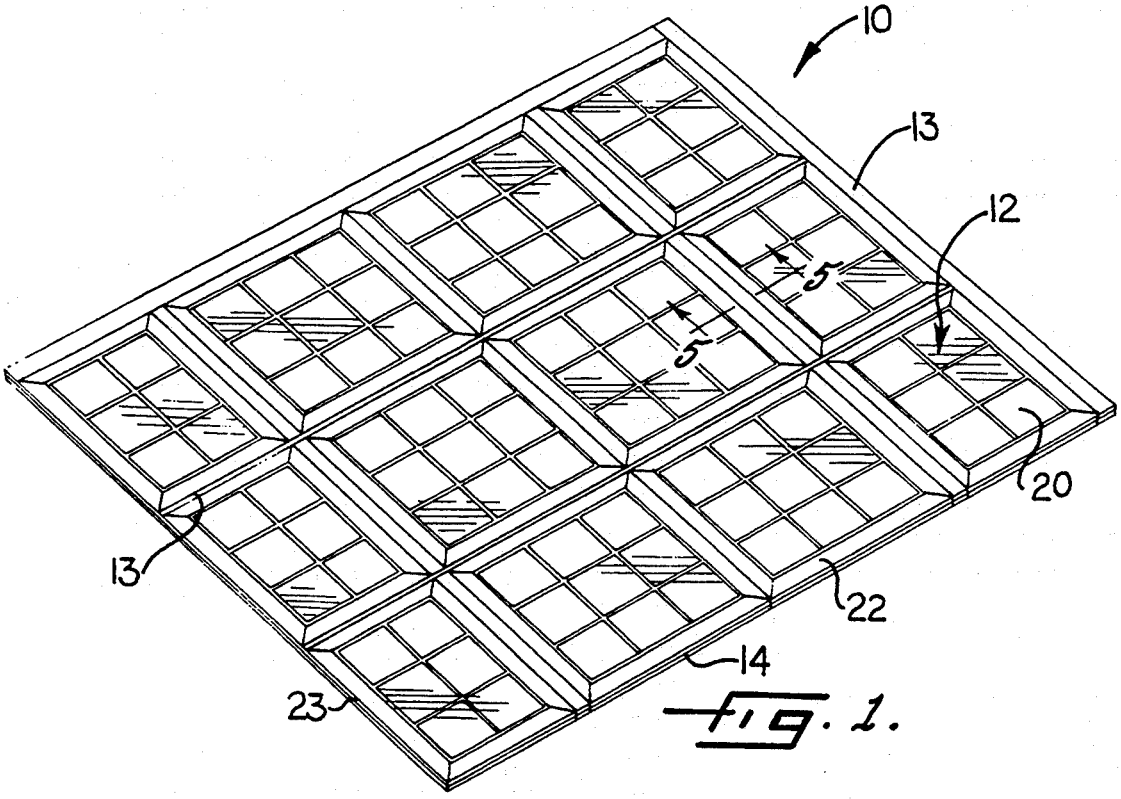
FIG. 1 a perspective view of a fully installed flooring system made in accordance with the present invention.

FIG. 1 illustrates one preferred embodiment of the invention, illustrated generally at 10. As shown, the flooring system 10 includes a plurality of modular flooring units 12 of pre-determined size and shape, and a plurality of elongate spacer strips 13 positioned adjacent and/or between the modular units 12.

Figure 2:
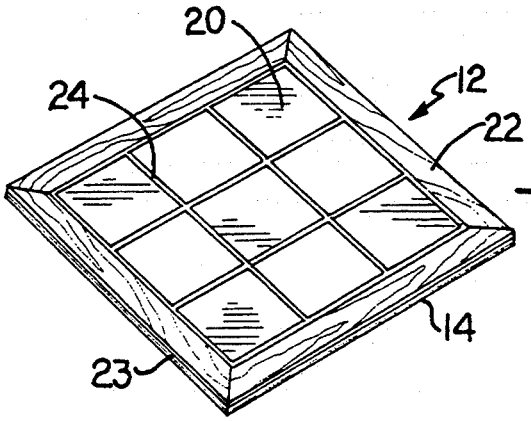
FIG. 2 is a perspective view of one preferred individual modular flooring unit.
Figure 3:
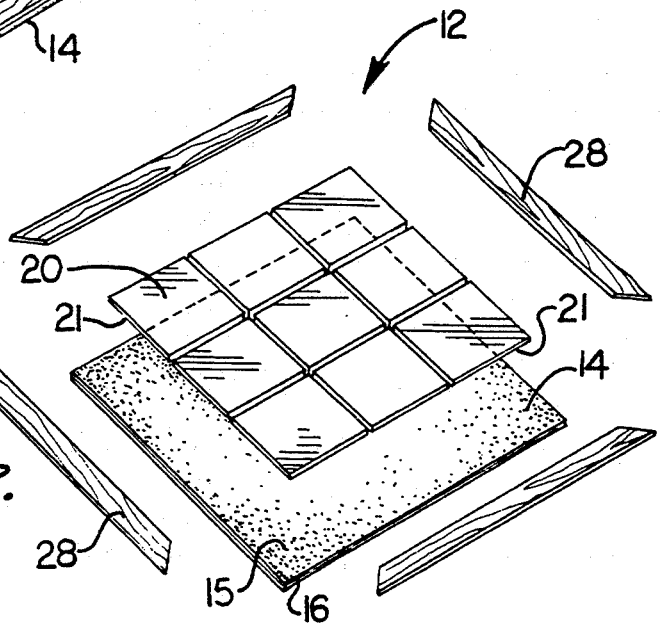
FIG. 3 is an exploded perspective view of the flooring unit illustrated in FIG. 2.

Referring now to FIGS. 2 and 3, the modular flooring units 12 include a rigid base 14 having upper and lower faces 15 and 16. At least one, and preferably a plurality of tiles 20, are bonded to the upper face 15 of the base 14. The tiles 20 have lateral edges 21.

The frame 22 is also affixed to the base 14. The frame 22 may consist of a plurality of frame members 28. The frame 22 extends around at the tiles 20 so as to surround the outermost lateral edges 21 of the tiles 20. The frame 22 thus defines the upper portion of peripheral edges 23 of the flooring unit 12. Also, mortar 24 preferably extends between the tiles 20 and between the tiles 20 and the frame 22.

In a preferred embodiment, the tiles 20 are made of stone, preferably slate. The tiles 20 may alternatively or in varying patterns be made of granite, marble or other stone, or of a ceramic material. It is also advantageous that the tiles 20 be bonded to the upper face 15 of the base 14 by an adhesive such as an epoxy based adhesive. Thus, no cementitious material is required for setting of the tiles 20 on base 15. Moreover, the mortar 24 can also be formed from an adhesive such as an epoxy adhesive or an adhesive filled with a particulate filler to mimic the appearance and texture of a conventional cementitious mortar.

Figure 4:
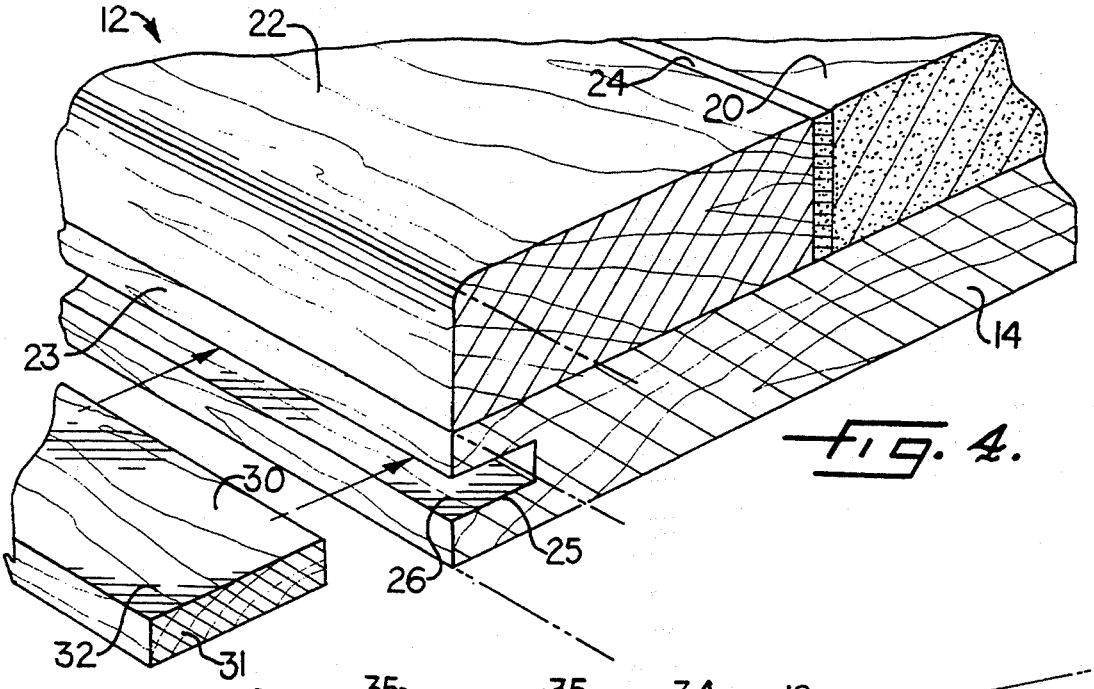
FIG. 4 is a greatly enlarged partial cross-sectional perspective view of the system of FIG. 1 illustrating the joining means of the flooring unit.

The rigid base 14, as best illustrated in FIGS. 3 and 4, should be sufficiently rigid so that the flooring unit 12 will not be substantially deformed by the stresses normally imposed during use of the flooring system 10. The base 14 is also advantageously impermeable to moisture so as to prevent expansion and contraction of the base with the possibility of concomitant harm to the tiles 20 mounted thereon. In the preferred embodiment, the base 14 is made of particle board, also known as chip board. It has been found particularly advantageous for the base 14 to be made of particle board approximately $\frac{3}{8}$ of an inch thick although this thickness can be varied.

Also in the preferred embodiment, the frame 22 is laterally compressible for absorbing stresses imposed between the flooring units 12. For example, such stresses may be imposed due to moisture absorption by the various components of the flooring system 10 or the surrounding environment, since many structures made of wood frequently expand or warp due to moisture absorption. Such expansion of the surface underlying the flooring system 10, the walls of a room surrounding the flooring system 10, or individual elements such as the members of the frame 22 may be caused by moisture absorption as well as thermal environmental conditions. Stresses may also be imposed in the flooring system 10 by sagging of the floor surface underlying the flooring system 10. The laterally compressible frame members 22 absorb these compressive stresses, thus relieving the bending or other undesired stresses that may otherwise be exerted on the tiles 20 and preventing the tiles 20 from being damaged. Otherwise, compressive forces acting on the lateral edges 21 of the tiles 20 could cause the tiles 20 to buckle and crack, thereby ruining the decorative appearance of the tiles 20.

In the preferred embodiment, the frame members 28 are glued to the upper face 15 of the base 14. Alternatively, the frame members 28 can be of a thickness equal to the sum of the thicknesses of a tile 20 and the base 15 and can be affixed to peripheral edges of the base 14. It will be apparent that the frames 22 can be affixed to the base by means other than gluing.

It has been found particularly advantageous to make the frame members 22 of wood or a wood-based material, especially hardwood such as oak or maple. Hardwood has been found particularly advantageous in view of its decorative properties and its surface durability as a flooring material. Other woods, such as pine, and other wood based or non-wood based materials may also be used.

It has been found desirable to coat the modular flooring portions 11, including both the modular flooring units 12 and elongate strips 13, with a protective coating or sealant to protect against staining and moisture absorption and to enhance the decorative appearance of the flooring system 10. In one particularly preferred embodiment, polyurethane is used as the protective coating/sealant.

Figure 6:
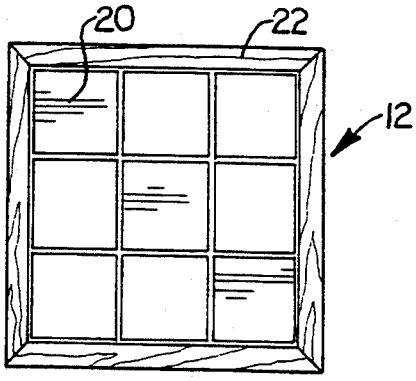
FIG. 6 is a plan view of the modular flooring unit shown in FIG. 2.
Figure 7:
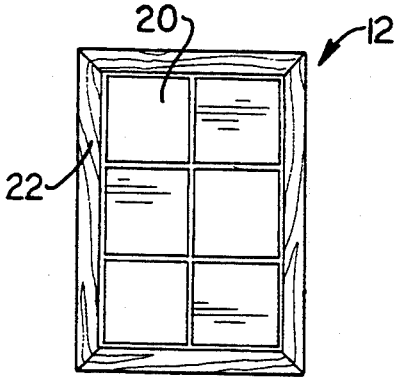
FIG. 7 is a plan view of an alternative embodiment of the modular flooring unit.
Figure 8:
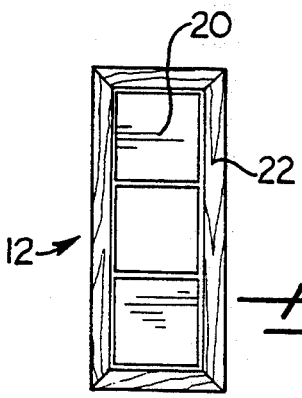
FIG. 8 is a plan view of still another embodiment of the modular flooring unit.

Referring now to FIGS. 6, 7 and 8, the modular flooring units 12 may be provided in a variety of sizes and shapes. In one particularly preferred embodiment, shown in FIG. 6, nine slate tiles 20 are provided so as to define a generally square shape for the modular flooring unit 12. As shown in FIG. 7, an orientation using six square slate tiles 20 may be used, thus defining a modular flooring unit 12 having a rectangular shape. FIG. 8 shows that three tiles 20 may be arranged to form a relatively narrow, rectangularly shaped modular flooring unit 12. Of course, other combinations of tiles of varying shapes and sizes may be used. For example, it is envisioned that other regular and irregular polygonal shapes, e.g., pentagonal, hexagonal, etc., can be defined by varying placements of tiles 20 and construction of the frame 22.

Figure 5:
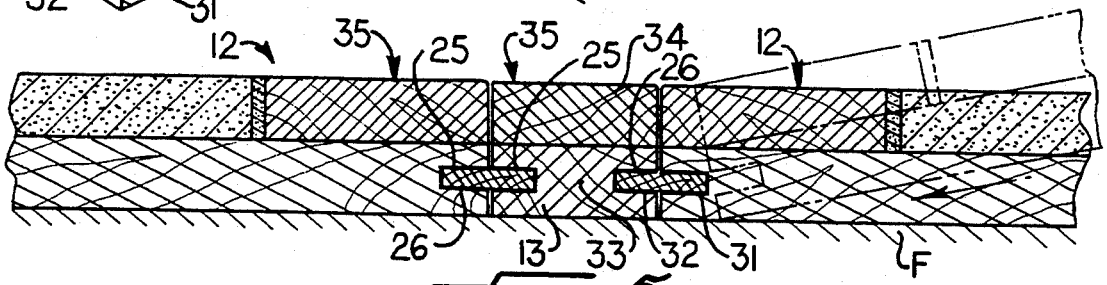
FIG. 5 is an enlarged cross-sectional view taken along line 5—5 of FIG. 1.

Referring now to FIGS. 4 and 5, the modular flooring units 12 and the elongate spacer strips 13 advantageously include joining means indicated generally at 25. The joining means 25 is associated with at least one peripheral edge 23 of the flooring unit 12 for joining the flooring unit 12 to another modular flooring unit 12, a spacing strip 13 or another flooring element of predetermined size and shape so that a plurality of the modular flooring units 12 with or without spacing strips 13 may be joined for installation on a pre-existing surface F without requiring preparation of a cementitious foundation to form the flooring system 10.

In one preferred embodiment, the joining means 24 is a slot 26 which has a size and shape for receiving a first side portion 30 of an elongate spline 31. As best seen in FIG. 5, the slot 26 has a depth equal to approximately half the width of the elongate spline 31. The slot 26 is also sufficiently wide to accommodate the thickness of the spline 31. Referring again to FIG. 4, when the first side portion 30 of the spline 31 is inserted into the slot 26, a second side portion 32 of the spline 31 protrudes from the slot 26. Looking again at FIG. 5, the second portion 32 of the spline 31 may then be received within a corresponding slot 26 in another modular flooring element. Thus, the modular flooring unit 12 may be joined to an adjacent flooring element by cooperation of the slots 26 and spline 31.

Figure 9:
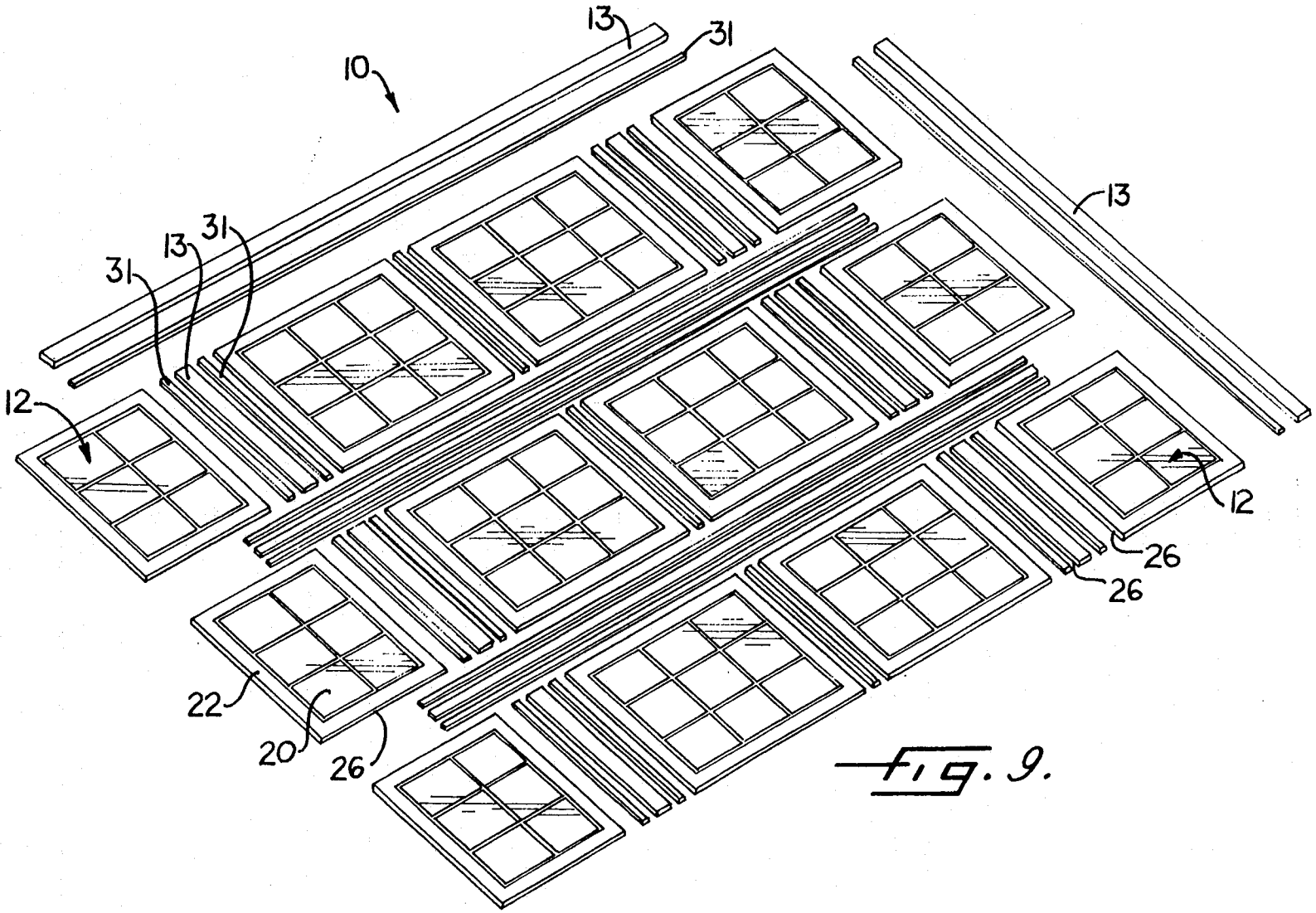
FIG. 9 is an exploded perspective view of the modular flooring system.

As best illustrated in FIGS. 4 and 9, the slots 26 preferably extend along each peripheral edge 23 of the flooring units 12. Thus, the flooring unit 12 may be joined along each edge thereof to an adjacent flooring element, such as either a flooring unit 12 or an elongate spacer strip 13.

The slots 26 may be formed in differing portions of the peripheral edges 23 of the units 12. In the particularly preferred embodiment illustrated in FIGS. 4 and 5, the slots 26 are formed in the portion of the peripheral edges 23 defined by the base 14. Alternatively, the slots 26 may be formed in the frame 22, between the juncture between the frame 22 and the base 14, or only partially along the edge so long as the other aspects concerning the size and shape of the slots 26 for receiving the splines 31 are satisfied. It will be apparent that other joining means can also be used in the invention or that the flooring elements can be affixed to the underlying floor F by adhesive or nails without other joining means being used. However, the use of splines and grooves in accordance with the preferred embodiment is particularly advantageous in that the flooring elements are maintained in horizontal alignment while some degree of bending of one rigid element relative to another is still possible.

As shown in cross-section in FIG. 5 and in perspective in FIG. 9, the elongate spacer strips 13 are preferably formed of a material having uniform width and may have a pre-determined length. In a preferred embodiment, the elongate strips 13 can include an underlying base 33 and an overlying facing material 34. It is advantageous that the base 33 be formed of a substantially moisture impermeable material such as particle board or chip board and the face layer be formed of a laterally compressible material such as wood or a wood-based material. Hardwood, and preferably oak, is advantageously used so as to complement the decorative appearance defined by the frame 22 of the modular flooring units 12. However, other materials, including differing types of wood, may be used to achieve the desired decorative appearance.

As illustrated in FIG. 5, the elongate spacer strips 13 may be positioned between adjacent flooring units 12 and joined in place therewith. As also shown in FIG. 5, the elongate strips 13 also include slots 26 for receiving a side portion 30 or 32 of an elongate spline 31. The slots 26 defined in the elongate strips 13 are at a height suitable for cooperating with the slots 26 on the adjacent flooring units 12. Also, although not explicitly shown, multiple elongate strips 13 may be positioned directly abutting each other to increase the spacing between flooring units 12. In addition, it will be apparent that the elongate spacer strips 13 can also function as the frame element 22 when a separate frame is not provided.

Advantageously, the length of the peripheral edges 23 of the flooring units 12 should not exceed about one meter. Preferably, the edges 23 should not exceed about 90 cm (35 in.). In a preferred embodiment, the modular flooring units illustrated in FIG. 6 are approximately 71 cm×71 cm. Likewise, the six tile flooring unit 20, shown in FIG. 7, may be about 51 cm. wide by 71 cm. long. Also, the three tile flooring unit 12 illustrated in FIG. 8 may be approximately 30 cm. wide×71 cm. long. With slate tiles, it has been found advantageous in each of these embodiments of the flooring units 12 to use tiles 20 having a thickness of approximately ½ inch. The frame 22 is also provided in a height of about ½ inch so as to create a co-planar surface with the top of the tiles 20. Also, as shown in FIG. 5, the thicknesses of the elongate strips 13 may be the same as the overall thickness of the flooring units 12 so as to define a substantially co-planar upper surface 35 when the flooring system 10 is assembled.

Likewise, in preferred embodiments, the elongate strips 13 may be provided in a variety of shapes and sizes. Advantageously the strips 13 can be provided in lengths of 6, 8 or 10 feet, although longer or shorter lengths may be used as desired. The strips are ideally provided in varying widths, such as 1, 2 and 3 inches, so that a strip 13 of an appropriate width may be selected to adjust the spacing between the flooring units 12 as desired. Of course, the strips 13 are typically cut by a user to accommodate a flooring system 10 of desired size. Strips 13 of a length corresponding to the dimensions of the flooring units 12 may also be provided. However, it is believed that since the elongate strips 13 are substantially uniform along their lengths, the longer lengths may be provided so that users may cut the lengths to a desired size for installation.

Referring now to FIGS. 1 and 9, a modular flooring system 10 may be formed by assembling multiple flooring elements, including various combinations of the flooring unit 12 and the elongate spacer strips 13. The combinations of the flooring elements may be chosen to permit maximum flexibility of installation and to permit the flooring system to cover a desired flooring area having a specific shape and size. As shown in FIG. 9, differing combinations of the various preferred embodiments of the flooring units 12 (as shown in FIGS. 6, 7 and 8) may be used to adjust the overall dimensions of the flooring system 10. If smaller dimensional adjustments must be made, varying combinations of the elongate spacer strips 13 may be placed within the flooring system 10, either by placing the strips 13 between the units 12 or alternatively, around the exterior periphery of the modular units 12. For example, it may be preferred to position a spacer strip 13 adjacent a room wall to insure a tight fit against the room wall. In each case, the flooring elements, including either the flooring units 12 and the elongate spacer strips 13, are joined to each other by the joining means such as the slots 26 and the splines 31. Likewise, multiple units 12 may be joined to each other, as illustrated in FIGS. 1 and 9, by cooperation of the slots 26 on adjacent units 12 and an intermediate spline 31, and multiple abutting spacer strips 13 may be adjoined by cooperating slots 26 and a spline 31.

The flooring system 10 of the invention provides for easy and quick installation above an existing floor surface F, such as a pre-existing wood floor in a home. Thus, the flooring system 10 is particularly desirable for use by homeowners for home improvement work. This advantage is particularly seen in that no mortar or glue is required for installation of the flooring system 10, and because the modular units 12 and spacer strips 13 are pre-finished and sealed with a protective coating such as polyurethane. Also, since the modular units 12 and spacer strips 13 may be installed in varying combinations, large areas, such as an interior room, small areas, such as an entrance hallway, or even a long, narrow area such as an interior hallway may be floored by installation of the system 10.

Moreover, since the base 14 is rigid and impervious to moisture and because the frame 22 of each modular unit 12 is laterally compressible to absorb stresses, preparation of a cementitious or other rigid undersupport, and grouting between the tiles 20, are not necessary at the site of installation of the system 10. Consequently, the time, labor and expense involved in installing brittle tile flooring made of materials such as slate, other stone, or ceramics are greatly reduced.

The invention has been described in considerable detail with reference to its preferred embodiments. However, it will be apparent that variations and modifications can be made within the spirit and scope of the invention as described in the foregoing detailed specification and defined in the appended claims.

What is claimed is:

1. A modular flooring unit, comprising:

a rigid base, said rigid base having upper and lower faces, peripheral edges, and a slot formed in at least one of said peripheral edges, said at least one peripheral edge being aligned above and below said slot;

at least one tile bonded to said upper face of said base and having lateral edges; and a compressible frame affixed to said base and extending around said at least one tile so as to surround said lateral edges of said at least one tile and further defining peripheral edges of the flooring unit;

said slot having a size and shape for receiving a first portion of an elongate spline so that a second portion of the spline protrudes from said slot, so that the second spline portion may be received within a corresponding slot defined in a different modular flooring element to join the different element to said unit.

2. A modular flooring unit as defined in claim 1 wherein said base is substantially impermeable to moisture.

3. A modular flooring unit as defined in claim 2 wherein said frame is hardwood and said base is particle board.

4. A modular flooring unit as defined in claim 1 wherein said tile is bonded to said base by adhesive.

5. A modular flooring unit as defined in claim 1 further comprising a plurality of said tiles and mortar extending between said tiles and between said tiles and said frame.

6. A modular flooring unit as defined in claim 5 wherein said tiles are stone.

7. A modular flooring unit as defined in claim 6 wherein said tiles are slate.

8. A modular flooring unit as defined in claim 5 wherein said tiles are ceramic.

9. A modular flooring unit as defined in claim 5 wherein said tiles and frame are coated with a sealant.

10. A modular flooring unit as defined in claim 1 wherein the length of each said peripheral edge is not more than about one meter.

11. A modular flooring unit as defined in claim 1 comprising at least one of said slots extending along each said peripheral edge of said base.

12. A modular flooring unit, comprising:

a rigid base having upper and lower faces;

at least one tile bonded to said upper face of said base and having lateral edges; and a compressible frame affixed to said base and extending around said at least one tile so as to surround said lateral edges of said at least one tile and further defining peripheral edges of the flooring unit;

joining means associated with at least one peripheral edge of the flooring unit for joining the flooring unit to a portion of a modular floor comprising flooring elements of predetermined size and shape, said joining means comprising a slot extending along said at least one edge, said slot having a size and shape for receiving a first portion of an elongate spline so that a second portion of the spline protrudes from said slot, so that the second spline portion may be received within a corresponding slot defined in a different modular flooring element to join the different element to said unit;

at least one of said slots extending along each said peripheral edge of said unit, and wherein said frame has a thickness substantially equal to the sum of the thicknesses of said tile and said base and wherein said frame is affixed to peripheral edges of said base.

13. A modular flooring system comprising:

a plurality of flooring units, said units comprising:

a rigid base having upper and lower faces;

a plurality of tiles bonded to said upper face of said base;

a frame affixed to said base and extending around said tiles so as to surround said tiles and to define peripheral edges of the flooring unit; and joining means associated with at least one said peripheral edge of the flooring unit for joining the flooring unit to a different modular flooring element;

at least one elongate spacer strip of predetermined width positioned between at least two of said flooring units; and at least one elongate spline and slots defined in an edge of said elongate strip and in at least one said peripheral edge of said flooring unit, each said slot having a size and shape for receiving a portion of said spline so that said spline extends between said slots.

14. A modular flooring system as defined in claim 13 wherein said spacer strip is positioned between two groups of aligned flooring units.

15. A modular flooring system, comprising:

a plurality of flooring units, said units comprising:

a rigid base having upper and lower faces;

a plurality of tiles bonded to said upper face of said base;

a frame affixed to said base and extending around said tiles so as to surround said tiles and to define peripheral edges of the flooring unit; and joining means associated with at least one said peripheral edge of the flooring unit for joining the flooring unit to a different modular flooring element; and at least one elongate spacer strip of predetermined width positioned between at least two of said flooring units, wherein said elongate spacer strip has an overlying facing material and an underlying base strip, and wherein said frame of each said flooring unit and said facing material of said elongate spacer strip are laterally compressible for absorbing forces exerted within the flooring system, and further wherein said base strip of said spacer strip and said base of each said flooring unit are substantially impermeable to moisture.

16. A modular flooring system as defined in claim 15 wherein said peripheral edges of each said flooring unit are not more than about one meter in length.

17. A modular flooring system as defined in claim 15 comprising a plurality of said elongate spacer strips and wherein at least one of said strips has a width different from another of said strips.

18. A modular flooring system as defined in claim 15 wherein said frame of said modular flooring units and said facing material of said elongate spacer strip are hardwood, and further wherein said base of said modular flooring units and said base strip of said elongate spacer strip are particle board.

* * * * *

UNITED STATES PATENT AND TRADEMARK OFFICE

CERTIFICATE OF CORRECTION

PATENT NO. : 5,438,809

DATED : August 8, 1995

INVENTOR(S) : Gernot Ehrlich

It is certified that error appears in the above-identified patent and that said Letters Patent is hereby corrected as shown below:

On the cover page, References, U.S. Patents, Col. 1, "Goozuer" should be --Goozner--

On the cover page, References, U.S. Patents, Col. 1, omit one occurrence of "4,947,602 8/1990 Pollasky" - duplicate listing Col. 3, line 52, after "Fig. 1" insert --is--

Signed and Sealed this

Twenty-eighth Day of November 1995

*Attest:*

Bruce Lehman

BRUCE LEHMAN

*Attesting Officer*

*Commissioner of Patents and Trademarks*